US007553237B2

(12) United States Patent
Rodriguez et al.

(10) Patent No.: US 7,553,237 B2
(45) Date of Patent: Jun. 30, 2009

(54) GAMING MACHINE WITH MODULAR ACTUATOR FOR REMOTE DOOR LATCH

(75) Inventors: Frank E. Rodriguez, Chicago, IL (US); Gregory J. Tastad, Kenosha, WI (US)

(73) Assignee: WMS Gaming Inc., Waukegan, IL (US)

( * ) Notice: Subject to any disclaimer, the term of this patent is extended or adjusted under 35 U.S.C. 154(b) by 500 days.

(21) Appl. No.: 11/387,169

(22) Filed: Mar. 23, 2006

(65) Prior Publication Data

US 2007/0225078 A1 Sep. 27, 2007

(51) Int. Cl.
*A63F 9/00* (2006.01)
*E05B 55/00* (2006.01)
*B65D 45/00* (2006.01)

(52) U.S. Cl. ..... 463/46; 70/256; 70/257; 70/263; 70/264; 292/137; 292/138; 292/139; 292/163

(58) Field of Classification Search ..... 463/46
See application file for complete search history.

(56) References Cited

U.S. PATENT DOCUMENTS 1,336,183 A * 4/1920 Bahr ..... 312/215
1,967,151 A * 7/1934 Lustick ..... 188/265
2,104,639 A * 1/1938 Dall ..... 49/24
3,145,741 A * 8/1964 Smith ..... 141/104
3,193,635 A * 7/1965 Hood, Jr. ..... 200/51.03
3,282,357 A * 11/1966 Bunn ..... 175/122
RE29,341 E * 8/1977 Peters et al. ..... 307/129
4,102,164 A * 7/1978 Barbush ..... 70/241
4,469,382 A * 9/1984 Slaats et al. ..... 312/219
4,516,007 A * 5/1985 Ringdahl et al. ..... 219/722
4,596,411 A 6/1986 Geringer et al.
4,703,147 A * 10/1987 Happ et al. ..... 219/722
4,714,075 A * 12/1987 Krauter et al. ..... 600/140
4,795,155 A 1/1989 Grande
4,802,353 A * 2/1989 Corder et al. ..... 70/277
5,092,148 A * 3/1992 Rong-Long ..... 70/278.3
5,224,707 A 7/1993 Martin
5,540,069 A * 7/1996 Muller et al. ..... 70/278.2
5,616,270 A 4/1997 Park et al.
5,771,722 A * 6/1998 DiVito et al. ..... 70/277
5,841,361 A * 11/1998 Hoffman ..... 340/5.54
5,890,439 A 4/1999 McGunn
6,011,999 A * 1/2000 Holmes ..... 700/231
6,066,038 A 5/2000 Sciortino et al.

(Continued)

*Primary Examiner*—Corbett Coburn
*Assistant Examiner*—Seng H. Lim
(74) *Attorney, Agent, or Firm*—Nixon Peabody LLP

(57) ABSTRACT

A gaming machine for conducting a wagering game includes a cabinet having a top box mounted on a main body. The top box has a door for allowing user access to an inner area of the top box. A lock assembly in the top box locks/unlocks the door and a release assembly in the main body operates the lock assembly. The lock assembly and the release assembly are configured to automatically engage one another when the top box is mounted on the main body. Thus, no manual connection is needed between the two assemblies and the lock assembly may be preinstalled independently of the release assembly. Moreover, any suitable top box design may be used with the lock assembly, and any suitable main body design may be used with the release assembly. This allows the top box to be selected much later in an assembly process than previously possible.

11 Claims, 7 Drawing Sheets

U.S. PATENT DOCUMENTS

| | | | | |
|---|---|---|---|---|
| 6,231,446 | B1 * | 5/2001 | Majima et al. | 463/46 |
| 6,251,014 | B1 * | 6/2001 | Stockdale et al. | 463/16 |
| 6,420,972 | B1 | 7/2002 | Loose | |
| 6,575,833 | B1 * | 6/2003 | Stockdale | 463/29 |
| 6,688,984 | B2 * | 2/2004 | Cole | 463/46 |
| 6,705,140 | B1 * | 3/2004 | Dimig et al. | 70/277 |
| 2002/0032051 | A1 * | 3/2002 | Stockdale | 463/29 |
| 2003/0190962 | A1 * | 10/2003 | Canterbury et al. | 463/47 |
| 2004/0092317 | A1 * | 5/2004 | Beirne | 463/46 |
| 2004/0192433 | A1 * | 9/2004 | Johnson | 463/20 |
| 2005/0054449 | A1 * | 3/2005 | Kopera et al. | 463/46 |
| 2005/0077995 | A1 * | 4/2005 | Paulsen et al. | 340/5.6 |
| 2005/0215325 | A1 * | 9/2005 | Nguyen et al. | 463/46 |
| 2006/0281558 | A1 * | 12/2006 | Rifkin et al. | 463/46 |
| 2007/0046423 | A1 * | 3/2007 | Baucom | 340/5.5 |
| 2007/0132551 | A1 * | 6/2007 | Mozer et al. | 340/5.52 |

* cited by examiner

GAMING MACHINE WITH MODULAR ACTUATOR FOR REMOTE DOOR LATCH

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and methods for assembling such gaming machines and, more particularly, to a gaming machine having a modular actuator mechanism for remotely releasing a door latch on the gaming machine.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, gaming machine manufacturers continuously develop new games and improved gaming enhancements that will attract frequent play through enhanced entertainment value to the player.

One concept that has been successfully employed to enhance the entertainment value of a game is the concept of a secondary or "bonus" game that may be played in conjunction with a "base" game. The bonus game may comprise any type of game, either similar to or completely different from the base game, which is entered upon the occurrence of a selected event or outcome in the base game. Generally, bonus games provide a greater expectation of winning than the base game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. The bonus game concept offers tremendous advantages in player appeal and excitement relative to other known games and is attractive to both players and operators. Still, there is a continuing need to develop gaming machines with new functions and features to satisfy the demands of players and operators.

One attempt to develop gaming machines with new functions and features involves adding a secondary display to the gaming machine. Gaming machines historically have only one display unit for displaying the base and any bonus games. A secondary display expands the range of possible new functions and features that may be implemented on the gaming machine. The secondary display may be mounted in the gaming machine by installing it in an upper section of the gaming machine, called a "top box." Such a top box may have different shapes, sizes, themes, and so forth, and may house different types of displays (e.g., CRT, LCD, transmissive display, etc.) depending on the particular design of the gaming machine.

The top box must allow access to the secondary display for maintenance and repair purposes without having to remove the entire top box. To this end, a door or hatch is typically mounted adjacent to the top box, usually on the front wall thereof. Repair and maintenance may then be performed on the secondary display via the door or hatch. The door or hatch typically has a locking mechanism that prevents unauthorized access to the gaming machine. A person may unlock the locking mechanism by operating a release mechanism located in the main body of the gaming machine (e.g., underneath the button panel of the gaming machine).

However, connecting a release mechanism in the main body of the gaming machine to a locking mechanism in the top box presents certain manufacturing challenges. For one thing, assembly of the gaming machine is made more difficult because the release mechanism must be manually connected to the locking mechanism at some point during the assembly (it is not practical to connect the two components ahead of time). This is exacerbated by the fact that the top box, cabinet, and any hatch door release mechanisms are often located in the same area and attached to the same release handle. Also, decisions regarding which type of top box to use must be made well in advance to ensure compatibility between any locking mechanism and release mechanism required. Thus, a need exists for a gaming machine with a locking mechanism that does not require manual connection to a release mechanism and can also be mounted or installed independently of the release mechanism (i.e., preinstalled). The present invention is directed to satisfying one or more of these needs and solving other problems as well.

SUMMARY OF THE INVENTION

According to one aspect of the present invention, a gaming machine for conducting a wagering game includes a wager input device operable to accept a wager input from a player at the gaming machine and a game display operable to display an outcome of a wagering game in response to the wager input, the outcome being randomly selected from a plurality of outcomes. The gaming machine further comprises a main body configured to house the game display and a top box mounted on the main body. The top box has a door adjacent thereto for allowing user access to an inner area of the top box. The top box further has a lock assembly installed therein comprising at least one lock operable to lock and unlock the door, a lock actuator operable to actuate the at least one lock, and a top box actuator line connecting the at least one lock to the lock actuator.

According to another aspect of the invention, a method of assembling a cabinet for a gaming machine comprises selecting a first top box for the gaming machine from a plurality of top boxes, the first top box having a first door adjacent thereto and a first lock assembly operable to lock and unlock the first door. The method further comprises mounting the first top box on a main body of the gaming machine, the main body having a release assembly installed therein and configured to engage the first lock assembly and operable to actuate the first lock assembly when the first top box is mounted on the main body. The method finally comprises replacing the first top box on the main body with a second top box, the second top box having a second door adjacent thereto and a second lock assembly operable to lock and unlock the second door. The release assembly is configured to engage the second lock assembly and operable to actuate the second lock assembly when the second top box is mounted on the main body.

According to yet another aspect of the invention, a gaming machine comprises a wager input device operable to accept a wager input from a player at the gaming machine and a game display operable to display an outcome of a wagering game in response to the wager input, the outcome being randomly selected from a plurality of outcomes. The gaming machine further comprises a main body configured to house the game display and a top box mounted on the main body. The top box has a door adjacent thereto for allowing user access to an inner area of the top box. A release assembly is installed within the main body for facilitating locking and unlocking of the door in the top box, the release assembly including a release actuator, a release operable to actuate the release actuator, and a main body actuator line connecting the release actuator to the release.

Additional aspects of the invention will be apparent to those of ordinary skill in the art in view of the detailed description of various embodiments, which is made with reference to the drawings, a brief description of which is provided below.

DETAILED DESCRIPTION

Figure 1:
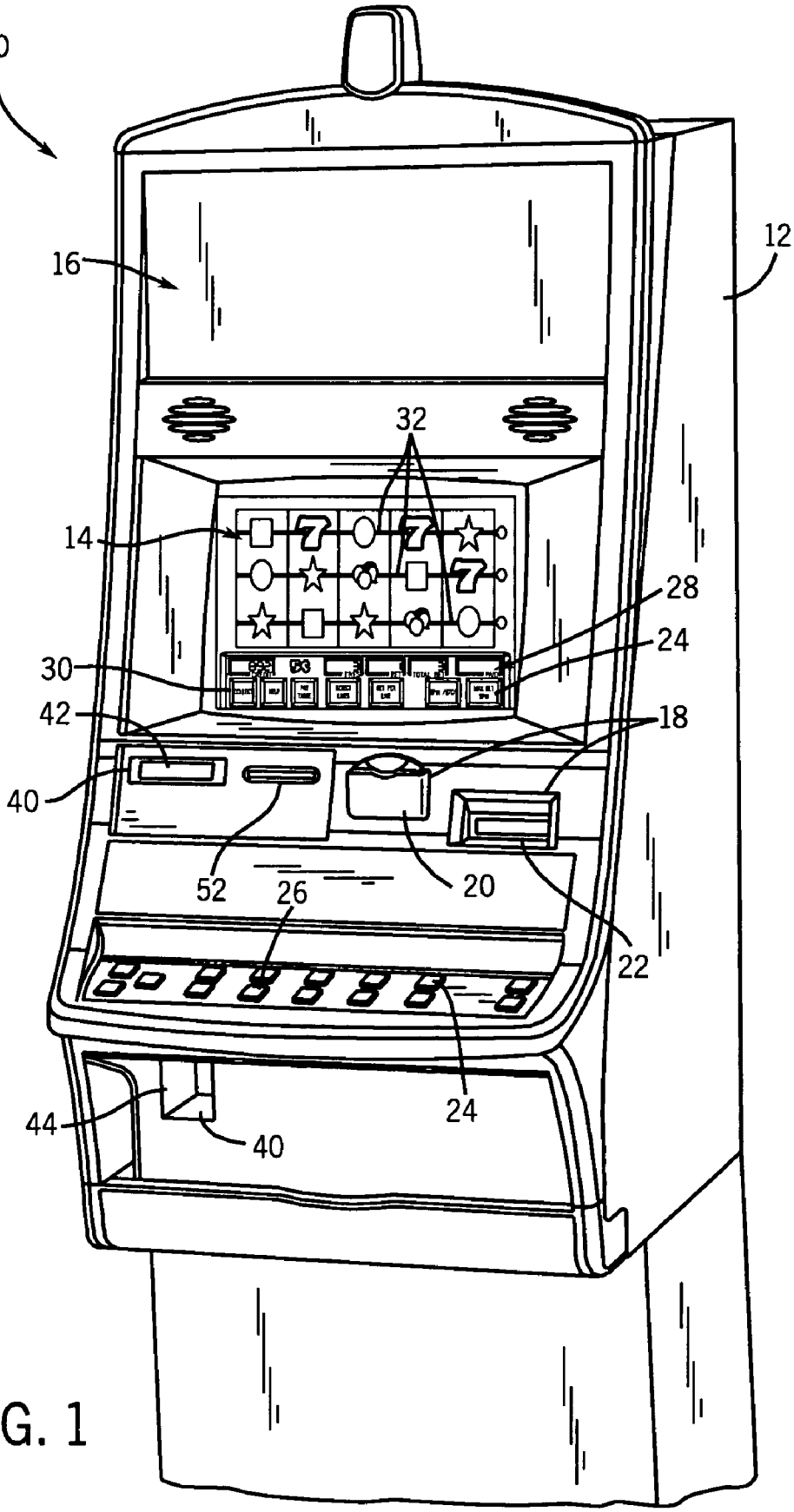
FIG. 1 illustrates a perspective view of a gaming machine according to embodiments of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the base wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits which are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an option on how to make their game selections. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the base wagering game is displayed to the player on the primary display 14. The primary display 14 can also display the bonus game associated with the base wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the base wagering game by making a wager via the value input device 18 of the gaming machine 10. A player can select play by using the player input device 24, via the buttons 26 or the touch screen keys 30. The base game consists of a plurality of symbols arranged in an array, and includes at least one payline 32 that indicates one or more outcomes of the base game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming terminal 10. The gaming terminal 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
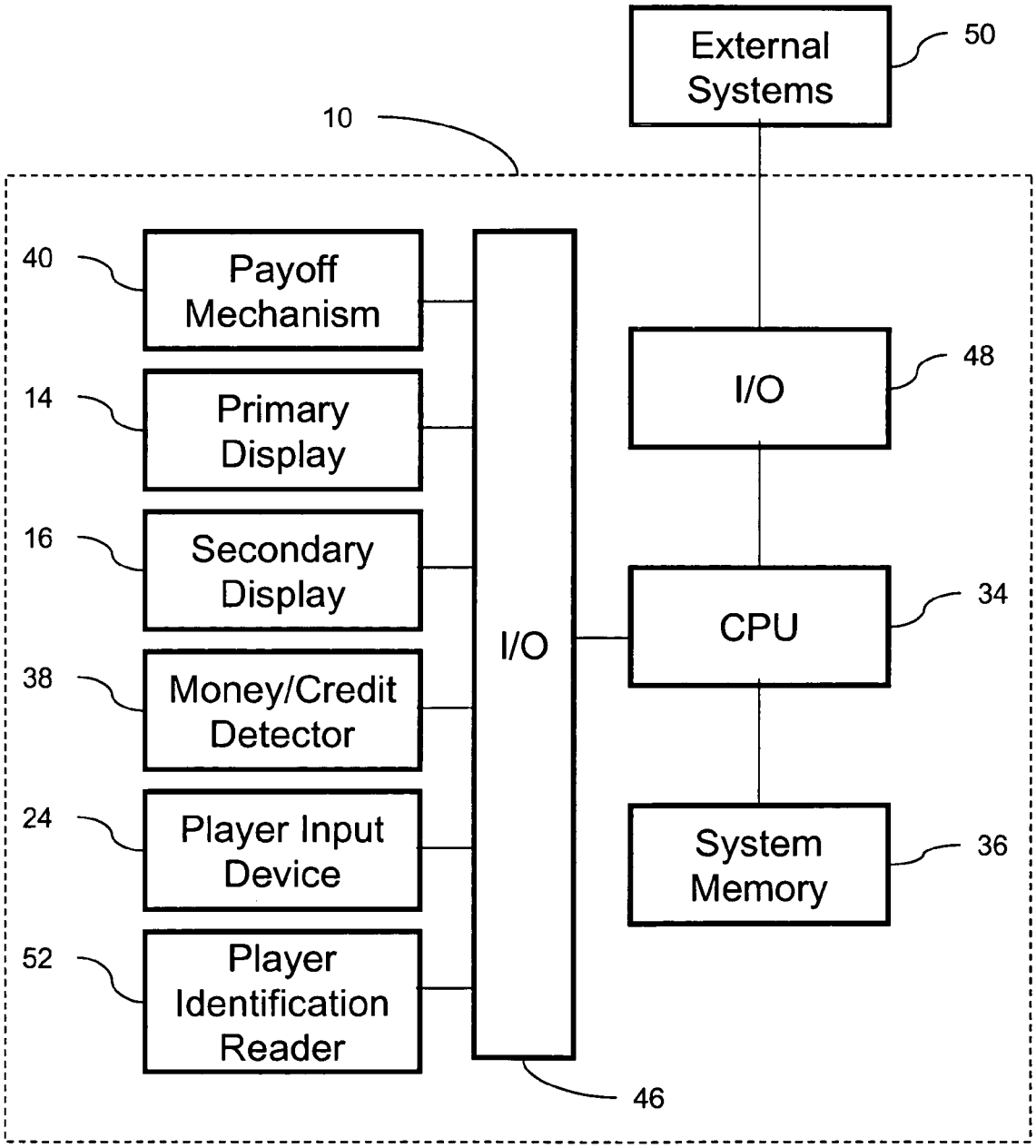
FIG. 2 illustrates a block diagram of a control system suitable for operating the gaming machine of FIG. 1.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the base game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10*b*T, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3B:
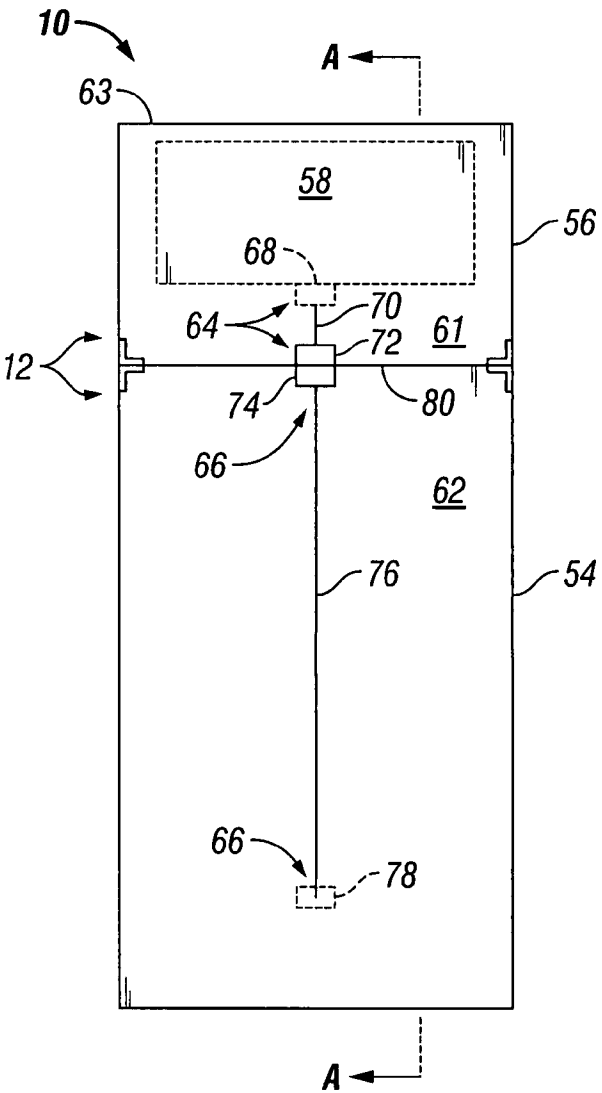
FIGS. 3A-3B illustrate cross-sectional side and front views of a gaming machine having a door lock assembly and a door release assembly according to embodiments of the invention.
Figure 3A:
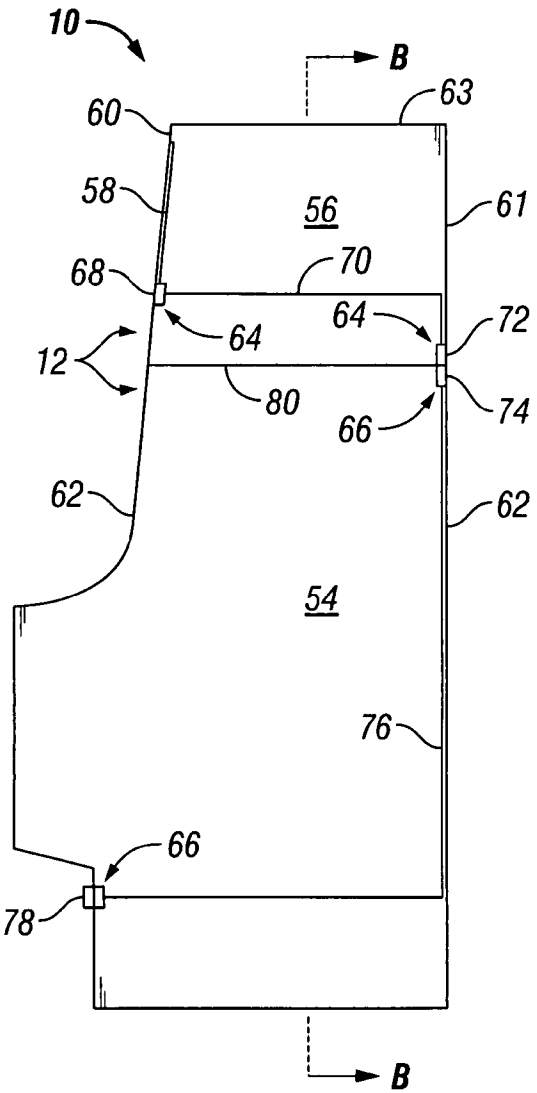

Turning now to FIGS. 3A-3B, cross-sectional side and front views of the gaming machine 10 according to embodiments of the invention are shown. As can be seen, the gaming machine 10 includes a cabinet 12 composed of two sections, a main body 54 and a top box 56 mounted on the main body 54. In general, the top box 56 houses the secondary display 16 while the main body 54 houses the primary display 14 along with various electronic components of the gaming machine 10. Certain gaming machines have only one display, however, in which case the top box 56 may simply house additional electronics. A door 58 is installed (e.g. hinged) adjacent to a front wall 60 of the top box 56 for allowing access to an inner area thereof (e.g., for maintenance and repair purposes). The door 58 may be mounted directly to the top box 56, or it may be mounted independently of the top box 56 (e.g., it may be hinged to the main body 54). Such a door 58 may or may not be flush with the front wall 60 and may also be mounted adjacent to a back wall 61, top wall 63, or side walls in some implementations. A lock assembly 64 in the top box 56 locks and unlocks the door 58, and a release assembly 66 in the main body 54 controls the operation of the lock assembly 64.

In accordance with embodiments of the invention, the lock assembly 64 and the release assembly 66 are configured to engage one another when the top box 56 is mounted on the main body 54. As a result, there is no need to manually connect a locking mechanism to a release mechanism, as in existing gaming machines. Because no manual connection is necessary, the lock assembly 64 may be installed in the top box 56 at any time (e.g., preinstalled) independently of the release assembly 66. The lock assembly 64 also does not require a particular top box design, but may be used with any suitable top box 56. Likewise, the release assembly 66 does not require a particular main body design, but may be used with any suitable main body 54. Such a modular arrangement allows the selection of which top box 56 to use with which main body 54 to be made much later in the process than previously possible. Moreover, one top box 56 may be removed and switched with another top box 56 without having to alter or otherwise accommodate the release assembly 66 in the main body 54. This allows casinos and gaming machine manufacturers to more easily swap out older top boxes for newer, upgraded versions.

In the implementation of FIGS. 3A-3B, the lock assembly 64 includes a lock 68 connected by an actuator line 70 to a lock actuator 72. Similarly, the release assembly 66 includes a release actuator 74 connected by an actuator line 76 to a release 78. The lock 68 of the lock assembly 64 may be mounted adjacent to the door 58 on an inner surface of the front wall 60 of the top box 56. The lock actuator 72 may be mounted on the same inner surface of the front wall 60 as the lock 68, or it may be mounted on a different wall of the top box 56 as needed, such as the back wall 61 (as shown here). The actuator line 70 (hereinafter "top box actuator line 70") may then be routed along any convenient path between the lock 68 and the lock actuator 72.

Whichever wall the lock actuator 72 is located on, it is preferably mounted near or flush (i.e., substantially flush) with a border or interface 80 between the top box 56 and the main body 54. The release actuator 74 may then be mounted adjacent to the lock actuator 72 on an inner surface of a corresponding wall (e.g., a back wall 62) in the main body 54. More specifically, the lock actuator 72 and the release actuator 74 may be positioned in their respective top box 58 and main body 54 so that the two actuators come in mechanical, electrical, magnetic, hydraulic, and/or pneumatic contact with one another when the top box 58 is placed on the main body 54. Such an arrangement eliminates the manual connection required in existing gaming machines to connect the locking mechanism in the top box to the release mechanism in the main body.

In some embodiments, the release 78 of the release assembly 66 may include a release activator 130 (see FIG. 7) that may be located at any convenient location on the main body 54 and accessed from an inner or an outer surface of the main body 54, for example, underneath the button panel. In one embodiment, the release 78 may be a key-based arrangement or some other restricted access arrangement that requires insertion of a specific key or entry of a code in order to operate the release actuator 74 (and thereby unlock the door 58). The key-based arrangement may provide direct access by allowing the release 78 to be externally actuated, or it may provide indirect access by allowing entry to an inner area of the main body 54 (e.g., through a hatch (not expressly shown)) from which the release 78 may be accessed. The actuator line 76 (hereinafter "main body actuator line 76") may then be routed along any convenient path between the release actuator 74 and the release 78.

To operate, a user manipulates the release mechanism 78 on the cabinet 12 to send a mechanical, electrical, magnetic, hydraulic, and/or pneumatic signal along the main body actuator line 76 to the release actuator 74. The signal from the release 78 causes the release actuator 74 to mechanically, electrically, magnetically, hydraulically, and/or pneumatically actuate the lock actuator 72. This causes a mechanical, electrical, magnetic, hydraulic, and/or pneumatic signal from the lock actuator 72 to be sent along the top box actuator line 72 to the lock 68. The signal from the lock actuator 72 actuates the lock 68, causing it to mechanically, electrically, magnetically, hydraulically, and/or pneumatically lock or unlock the door 58. The user may thereafter open the door 58 (if unlocked) or secure the door (if locked) as needed.

Figure 4:
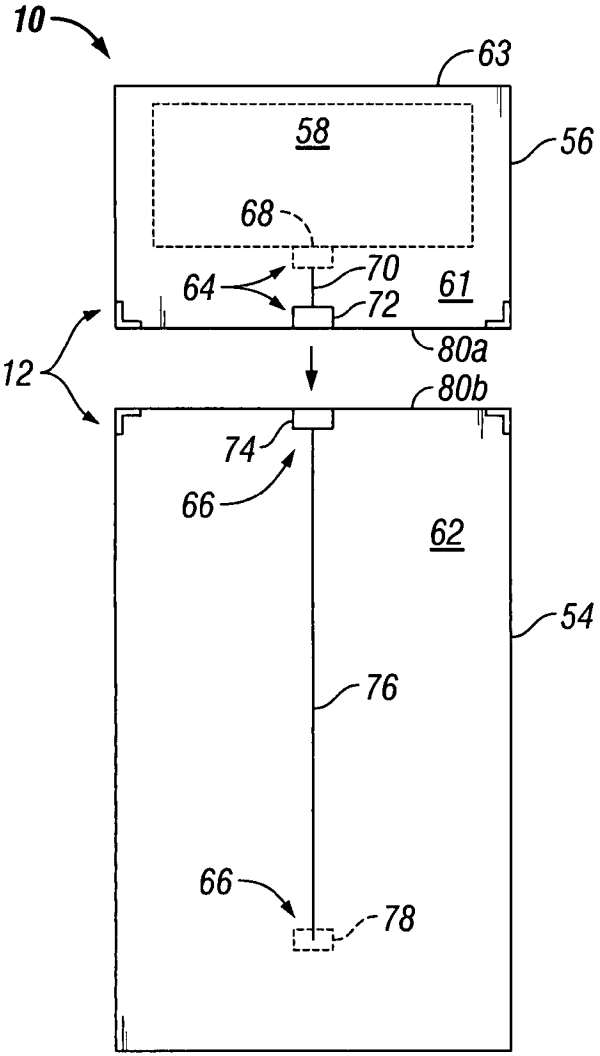
FIG. 4 illustrates an exemplary method of assembling the gaming machine having a door lock assembly and a door release assembly according to embodiments of the invention.

FIG. 4 illustrates an exemplary method of assembling the lock assembly 64 and the release assembly 66 of the gaming machine 10. The gaming machine 10 may be a brand new gaming machine being assembled for the first time, or it may be an existing gaming machine being upgraded with a different top box 56. Upon selecting a particular top box 56 from several available top boxes 56, the lock 68 of the lock assembly 64 is installed on the front wall 60 of the selected top box 56. Preferably, the lock 68 of the lock assembly 64 is placed adjacent to the door 58, while the lock actuator 72 is mounted on the back wall 61 substantially flush with a bottom edge 80*a* of the top box 56. The release assembly 66 is installed in the main body 54, with the release actuator 74 mounted on the corresponding back wall 62 of the main body 54 substantially flush with a top edge 80*b* of the main body 54. The release 78 may then be mounted at any convenient location on an outer surface of the main body 54.

In accordance with embodiments of the invention, the lock assembly 64 may be mounted in the top box 56 independently of the main body 54, and the release assembly 66 may be mounted in the main body 54 independently of the top box 56. This allows the top box 56 and the main body 54 to be put into the assembly process with the lock assembly 64 and the release assembly 66 already preinstalled. The top box 56 may then be placed on the main body 54 at any time to assemble the lock assembly 64 and the release assembly 66 (preferably using slits, notches, or some other type of alignment mechanism). The predetermined placement of the lock actuator 72 and the release actuator 74 causes these two components to come into mechanical, electrical, magnetic, hydraulic, and/or pneumatic contact with one another. Such an arrangement allows any top box 56 to be used with any main body 54 provided the lock actuator 72 of the lock assembly 64 and a release actuator 74 of the release assembly 66 are placed as described above.

Figure 5:
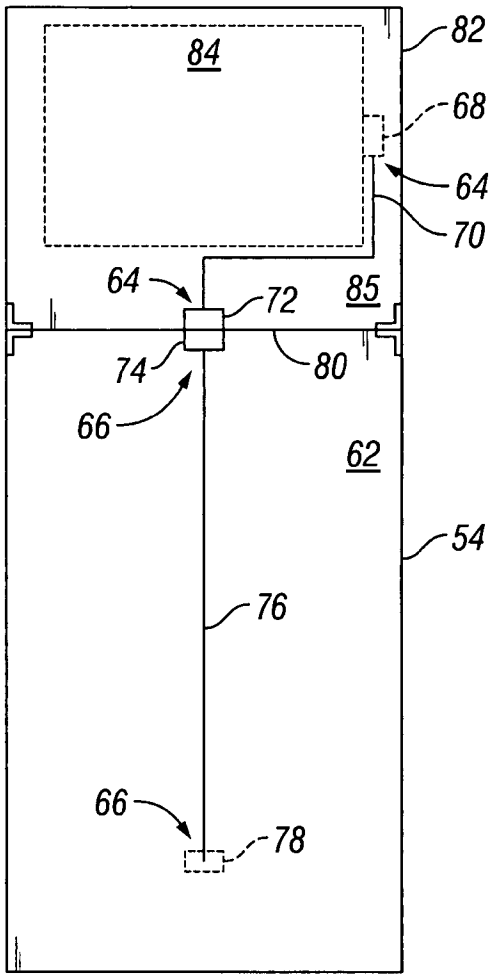
FIG. 5 is a cross-sectional front view of another gaming machine having a door lock assembly and a door release assembly according to embodiments of the invention.

FIG. 5 illustrates the flexibility achieved using embodiments of the invention. In this example, a gaming machine having a different top box 82 is mounted on the main body 54. The top box 82 in this implementation is taller than the top box 56 in the implementation of FIGS. 3A-3B and also has a bigger door 84 mounted, for example, adjacent to a front wall thereof. In accordance with embodiments of the invention, the same lock assembly 64 and release assembly 66 may be used with the top box 82. To illustrate this flexibility, the lock 68 in this implementation is located to one side of the door 84 instead of at the bottom of the door 84. The lock actuator 72, as before, is mounted on an inner surface of a back wall 85 of the top box 82 substantially flush with a border or interface 80 between the top box 82 and the main body 54 and aligned with the release actuator 74. It is also possible to use another lock assembly for the top box 82, for example, one that has a longer/shorter actuator line or a different type of lock or lock actuator, or one with multiple locks that can all be actuated by the same lock actuator. Operation of the other lock assembly, however, is essentially identical to that of the implementation of FIGS. 3A-3B.

The components of the lock assembly 64 and the release assembly 66, including the lock 68, top box actuator line 70, lock actuator 72, release actuator 74, main body actuator line 76, and release 78, may be any suitable mechanical, electrical, magnetic, hydraulic, and/or pneumatic components known to those having ordinary skill in the art. These components may be available from a number of manufacturers, including Southco of Concordville, Pa., USA and Eberhard Hardware Manufacturing of Strongsville, Ohio. Following is an exemplary implementation of the lock assembly 64 and the release assembly 66 using mechanical components known to those having ordinary skill in the art.

Figure 6:
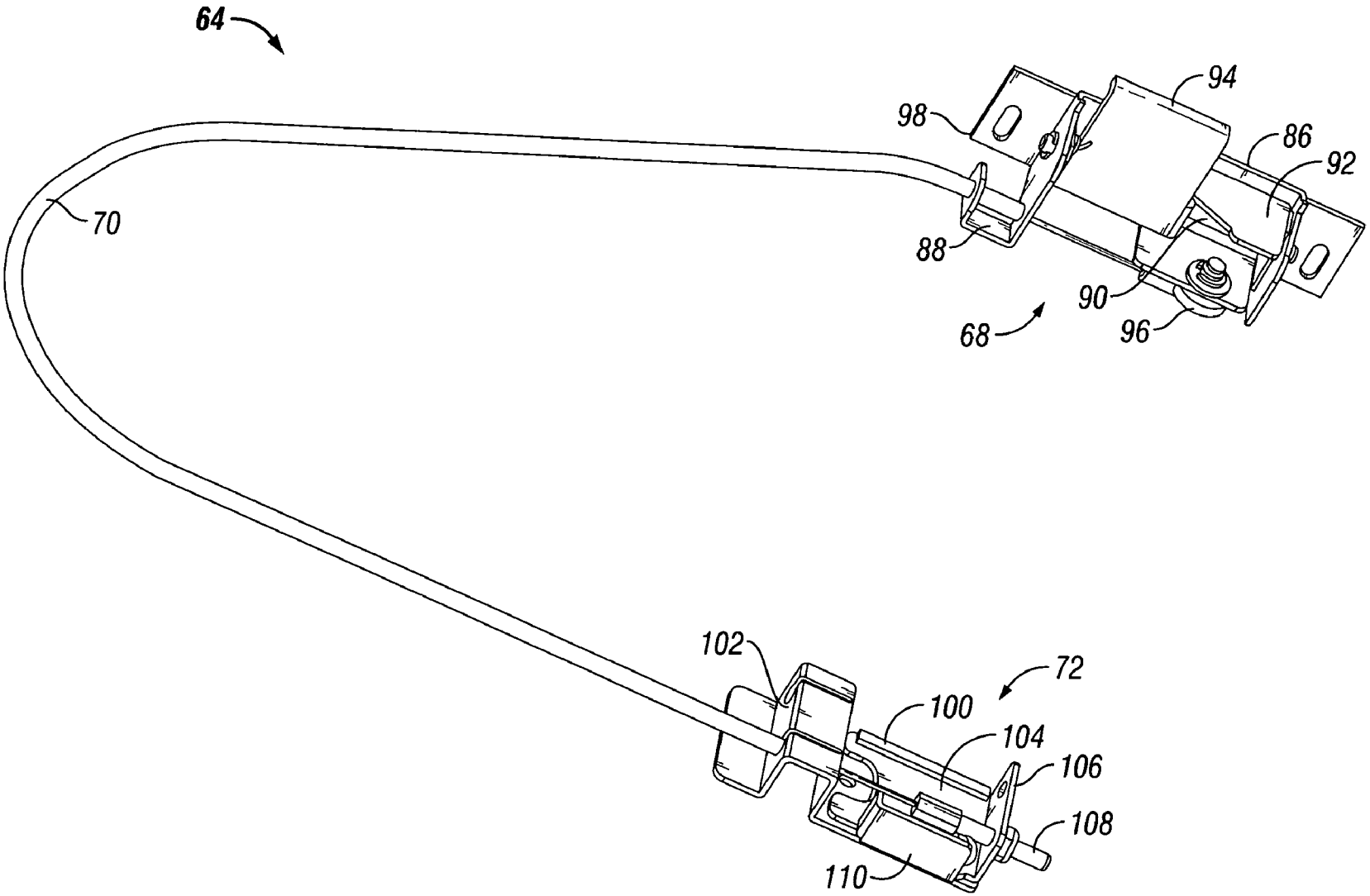
FIG. 6 illustrates an exemplary implementation of a door lock assembly according to embodiments of the invention.

As can be seen in FIG. 6, in one implementation, the lock 68 of the lock assembly 64 is composed of a rectangular-shaped housing 86 having a line stop 88 protruding from an end thereof. The line stop 88 is designed to receive and hold the top box actuator line 70 which, in this implementation, is an ordinary cable and sleeve arrangement. An axel 90 extends lengthwise through the ends of the housing 86 for allowing a channel 92 and a latch 94 to slide along and rotate about the axel 90, respectively. The latch 94 has a curved portion for latching the door 58 (or 84) and is spring-loaded to maintain the latch 94 in a normally closed or latched position. One side of the channel 92 engages the latch 94 and is tapered towards the latch 94 such that sliding the channel 92 towards the latch 94 forces the latch 94 open. The other side of the channel 92 is connected (e.g., bolted, screwed, etc.) to a cable termination 96 terminating the cable of the top box actuator line 70. An attachment plate 98 attached (e.g., welded, screwed, etc.) to the housing 86 allows the lock 68 to be mounted to the top box 56 as needed.

Referring still to FIG. 6, the top box actuator line 70 is connected at its other end to the lock actuator 72. The lock actuator 72 is composed of a rectangular-shaped jacket 100 having a line stop 102 protruding from an end thereof. As with the lock 68, the line stop 102 is designed to receive and hold the cable and sleeve arrangement of the top box actuator line 70. Note that the line stop 102 actually has accommodations for multiple actuator lines 70, thereby allowing the lock actuator 72 to actuate multiple locks 68 at the same time. An insert 104 is slidably disposed in the jacket 100 in a manner that allows the insert 104 to freely slide lengthwise between the two ends of the jacket 100. A transverse backplate 106 extending perpendicularly from one end of the insert 104 anchors a cable termination 108 terminating the cable of the top box actuator line 70. The insert 104 also includes a longitudinal base plate 110 extending perpendicularly therefrom. The base plate 110 is designed to engage the release actuator 74 to thereby move/slide the insert 104 back-and-forth between open and closed positions within the jacket 100, as will be explained below.

Figure 7:
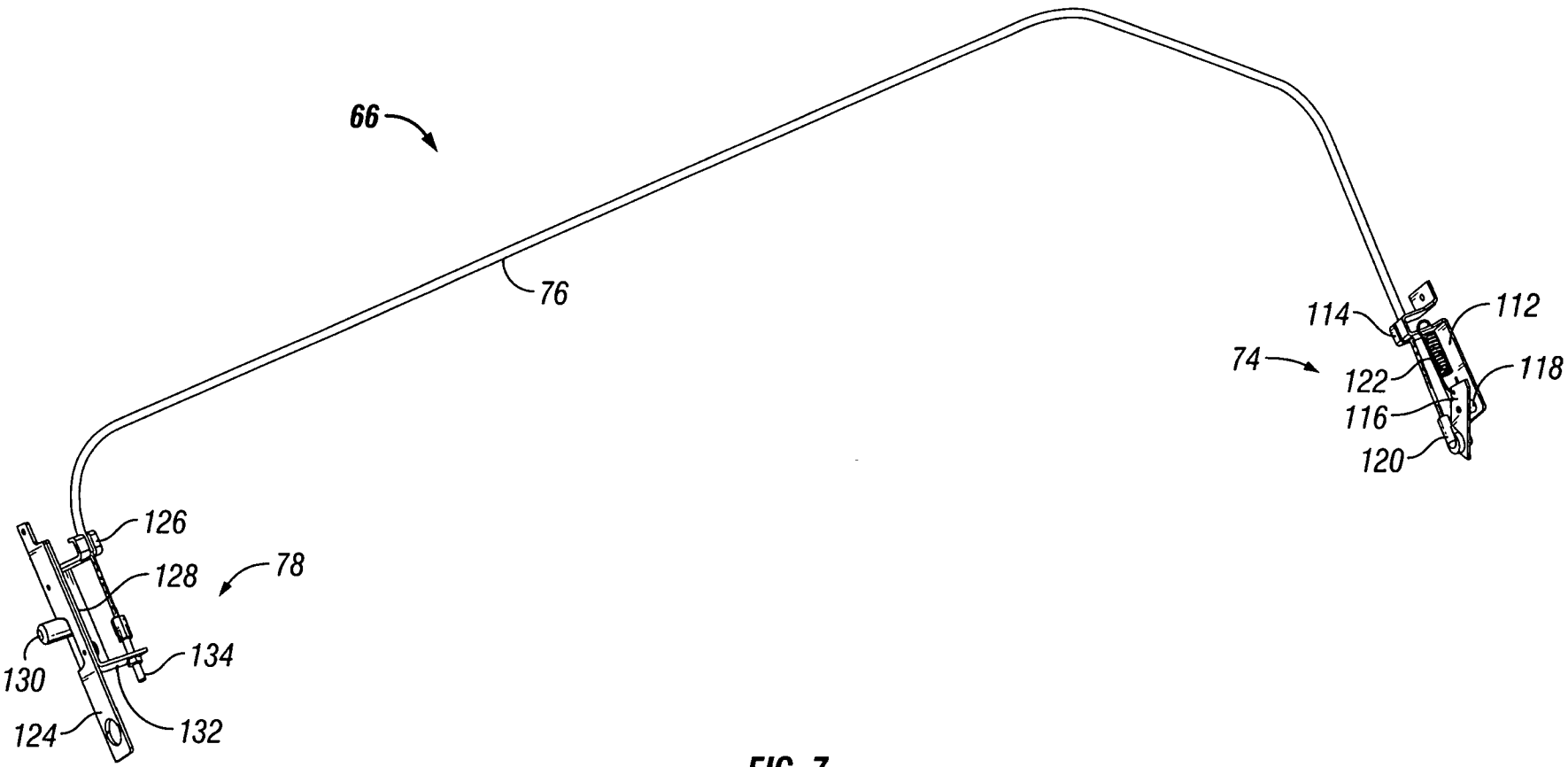
FIG. 7 illustrates an exemplary implementation of a door release assembly according to embodiments of the invention.

Turning now to FIG. 7, in one implementation, the release actuator 74 (to which the lock actuator 72 is coupled) is composed of a rectangular-shaped bracket 112 having a line stop 114 protruding from an end thereof. The line stop 114 is designed to receive and hold the main body actuator line 76 which, in this implementation, is another cable and sleeve arrangement. A blade 116 is pivotably mounted about a pivot 118 in the bracket 112 that allows the blade 116 to rotate between open and closed positions. One end of the blade 116 is connected to a cable termination 120 terminating the cable of the main body actuator line 76. The other end of the blade 116 is attached to a spring 122 that is anchored to the line stop 114 and keeps the blade 116 in a normally closed position.

Connected to the other end of the main body actuator line 76 is the release 78. In one implementation, the release 78 may be composed of a carriage 124 having a line stop 126 protruding from an end thereof. As with the release actuator 74, the line stop 126 is designed to receive and hold the cable and sleeve arrangement of the main body actuator line 76. A slidable plate 128 is disposed flush against the carriage 124, but in a manner that allows the slidable plate to freely slide back and forth along the carriage 124. The slidable plate 128 has a release activator 130, such as a handle, protruding therefrom that extends through an opening in the carriage 124 for allowing a user to manually slide the slidable plate 128. As mentioned above, the release activator 130 may be located at any convenient location and accessed from an inner or an outer surface of the main body 54. The other components of the release 78 are contemplated as being mounted internally only unless they are fully enclosed (in which case they may also be mounted externally). A transverse backplate 134 extending perpendicularly from one end of the slidable plate 128 anchors a cable termination 134 terminating the cable of the main body actuator line 76.

Figure 8:
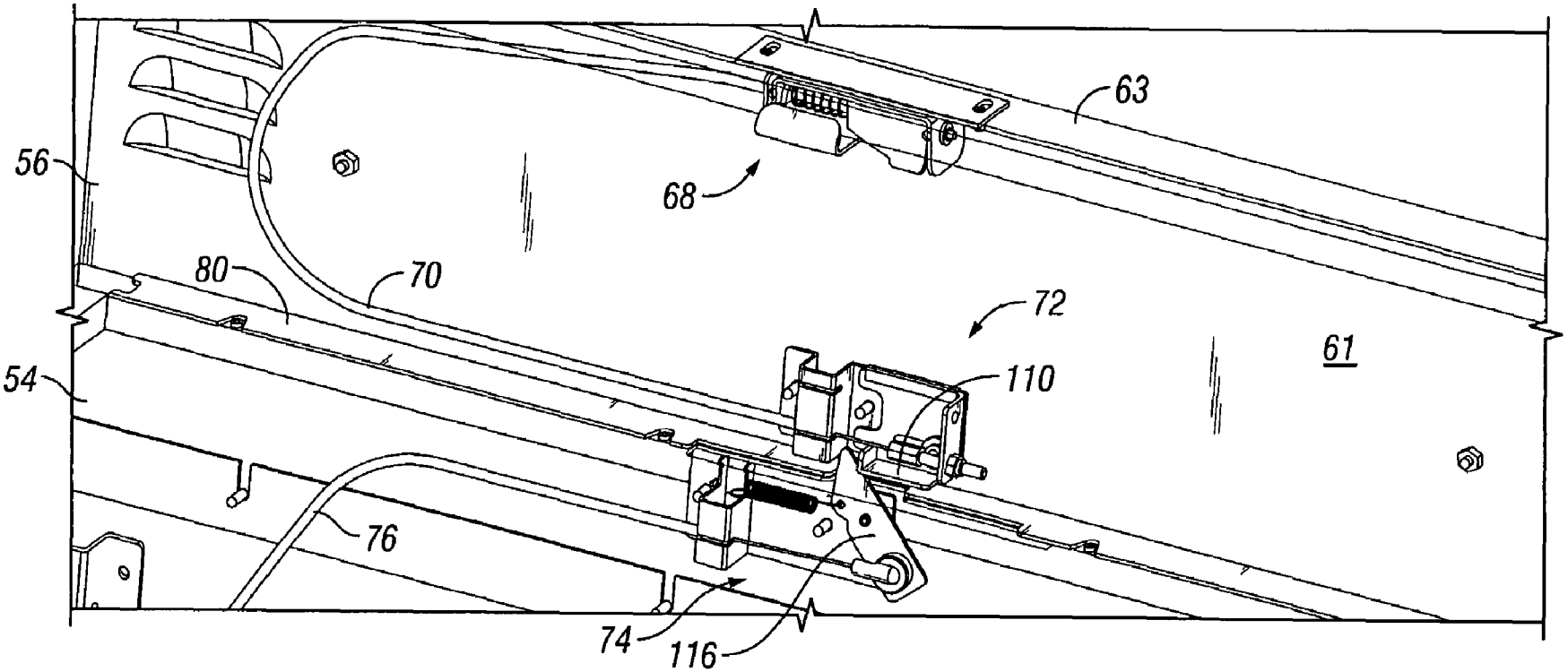
FIG. 8 illustrates an exemplary engagement of the door lock assembly and the door release assembly according to embodiments of the invention.

FIG. 8 illustrates the lock actuator 72 coupled to the release actuator 74. As can be seen, both the lock actuator 72 and the release actuator 74 are mounted on their respective back walls 61 and 62 of the top box 56 and main body 54 at the boundary or interface 80 thereof. Meanwhile, the lock 68 in this implementation is mounted on an inner surface of the top wall 63 of the top box 56 corresponding to a door (not expressly shown) located adjacent to the top wall 63. When the top box 56 is placed on the main body 54, the blade 116 of the release actuator 74 automatically comes into contact with the base plate 110 of the lock actuator 72. Thus, no manual connection is needed to engage the lock actuator 72 and release actuator 74, thereby giving rise to the advantages and benefits mentioned above.

In operation, a user moves the release activator (e.g., handle) 130 (FIG. 7) in an appropriate direction, depending on whether he/she wishes to open or close the door 58. The motion of the handle 130 slides the slidable plate 128, thereby pushing or pulling the cable of the main body actuator line 76. At the other end of the main body actuator line 76, the cable causes the blade 116 of the release actuator 74 to rotate from one position to the other. The rotation of the blade 116 causes the base plate 110 of the lock actuator 72 to move accordingly, thereby sliding the slidable insert 104 (FIG. 6) to the open or the closed position. As the slidable insert 104 slides, it pushes or pulls the cable of the top box actuator line 70, thereby causing the channel 92 (FIG. 6) of the lock 68 (FIG. 6) to open or close the latch 94 (FIG. 6) accordingly.

Each of these embodiments and obvious variations thereof is contemplated as falling within the spirit and scope of the claimed invention, which is set forth in the following claims.

What is claimed is:

1. A gaming machine comprising:

a wager input device operable to accept a wager input from a player at said gaming machine;

a game display operable to display an outcome of a wagering game in response to said wager input, said outcome being randomly selected from a plurality of outcomes;

a main body configured to house said game display, said main body comprising a release assembly, said release assembly including a release actuator operable to actuate a lock actuator, a release operable to actuate said release actuator, and a main body actuator line connecting said release actuator to said release;

a separable top box mounted on said main body, said top box having a door adjacent thereto for allowing user access to an inner area of said top box; and a lock assembly installed as a component of said top box, said lock assembly including at least one lock operable to lock and unlock said door, the lock actuator operable to actuate said at least one lock, and a top box actuator line connecting said at least one lock to said lock actuator;

wherein said release actuator automatically contacts said lock actuator in response to said top box being placed on said main body.

2. The gaming machine according to claim 1, wherein said lock actuator is installed within said top box substantially flush with a bottom edge of an inner surface of said top box.

3. The gaming machine according to claim 2, wherein said release includes a restricted access arrangement that provides direct access or indirect access to said gaming machine.

4. The gaming machine according to claim 2, wherein said release actuator is installed within said main body substantially flush with a top edge of an inner wall of said main body and adjacent to said lock actuator.

5. The gaming machine according to claim 2, wherein said release actuator comes into contact with said lock actuator via a mechanical connection, an electrical connection, a magnetic connection, a hydraulic connection, or a pneumatic connection.

6. A gaming machine comprising: a wager input device operable to accept a wager input from a player at said gaming machine;

a separable game display operable to display an outcome of a wagering game in response to said wager input, said outcome being randomly selected from a plurality of outcomes;

a main body configured to house said game display;

a top box mounted on said main body, said top box having a door adjacent thereto for allowing user access to an inner area of said top box, said top box comprising a lock assembly installed as a component of said top box, said lock assembly including at least one lock operable to lock and unlock said door, a lock actuator operable to actuate said at least one lock, and a top box actuator line connecting said lock actuator to said at least one lock; and a release assembly installed within said main body for facilitating locking and unlocking of said door in said top box, said release assembly including a release actuator, a release operable to actuate said release actuator, and a main body actuator line connecting said release actuator to said release;

wherein said release actuator automatically comes into contact with said lock actuator responsive to said top box being placed on said main body.

7. The gaming machine according to claim 6, wherein said release actuator is installed within said main body substantially flush with a top edge of an inner surface of said main body.

8. The gaming machine according to claim 7, wherein said release includes a restricted access arrangement that provides direct access or indirect access to said gaming machine.

9. The gaming machine according to claim 7, wherein said lock actuator is installed within said top box substantially flush with a bottom edge of an inner surface of said top box and adjacent to said release actuator.

10. The method according to claim 7, wherein said release actuator comes into contact with said lock actuator via a mechanical connection, an electrical connection, a magnetic connection, a hydraulic connection, or a pneumatic connection.

11. A gaming machine comprising:

a wager input device operable to accept a wager input from a player at said gaming machine;

a game display operable to display an outcome of a wagering game in response to said wager input, said outcome being randomly selected from a plurality of outcomes;

a main body configured to house said game display, said main body comprising a release assembly, said release assembly including a release actuator operable to actuate a lock actuator, a release operable to actuate said release actuator, and a main body actuator line connecting said release actuator to said release;

a separable top box mounted on said main body, said top box having a door adjacent thereto for allowing user access to an inner area of said top box; and a lock assembly installed completely within said top box, said lock assembly including at least one lock operable to lock and unlock said door, the lock actuator operable to actuate said at least one lock, and a top box actuator line connecting said at least one lock to said lock actuator;

wherein said release actuator automatically contacts said lock actuator in response to said top box being placed on said main body.

* * * * *

UNITED STATES PATENT AND TRADEMARK OFFICE

CERTIFICATE OF CORRECTION

PATENT NO. : 7,553,237 B2
APPLICATION NO. : 11/387169
DATED : June 30, 2009
INVENTOR(S) : Frank E. Rodriguez and Gregory J. Tastad It is certified that error appears in the above-identified patent and that said Letters Patent is hereby corrected as shown below:

Col. 11 lines 19-44 Claim 6 should read

6. A gaming machine comprising: a wager input device operable to accept a wager input from a player at said gaming machine;

a game display operable to display an outcome of a wagering game in response to said wager input, said outcome being randomly selected from a plurality of outcomes;

a main body configured to house said game display;

a seperable top box mounted on said main body, said top box having a door adjacent thereto for allowing user access to an inner area of said top box, said top box comprising a lock assembly installed as a component of said top box, said lock assembly including at least one lock operable to lock and unlock said door, a lock actuator operable to actuate said at least one lock, and a top box actuator line connecting said lock actuator to said at least one lock; and a release assembly installed within said main body for facilitating locking and unlocking of said door in said top box, said release assembly including a release actuator, a release operable to actuate said release actuator, and a main body actuator line connecting said release actuator to said release;

wherein said release actuator automatically comes into contact with said lock actuator responsive to said top box being placed on said main body.

Signed and Sealed this

Eighth Day of September, 2009

David J. Kappos

David J. Kappos
*Director of the United States Patent and Trademark Office*